US008172621B2

(12) United States Patent
Chen

(10) Patent No.: US 8,172,621 B2
(45) Date of Patent: May 8, 2012

(54) ELECTRICAL CONNECTOR WITH METALLIC WIRE CONTACTS

(75) Inventor: De-Jin Chen, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 109 days.

(21) Appl. No.: 12/833,009

(22) Filed: Jul. 9, 2010

(65) Prior Publication Data

US 2011/0045707 A1 Feb. 24, 2011

(30) Foreign Application Priority Data

Aug. 20, 2009 (CN) ..... 2009 2 0308433 U
Oct. 29, 2009 (CN) ..... 2009 2 0313499 U
Nov. 2, 2009 (CN) ..... 2009 2 0313853 U

(51) Int. Cl.
*H01R 24/00* (2006.01)

(52) U.S. Cl. ..... 439/676; 439/83

(58) Field of Classification Search ..... 439/83, 439/676

See application file for complete search history.

(56) References Cited

U.S. PATENT DOCUMENTS 4,556,264 A * 12/1985 Tanaka ..... 439/62
6,116,964 A * 9/2000 Goodrich et al. ..... 439/676
6,183,308 B1 * 2/2001 Laity ..... 439/676
6,186,834 B1 * 2/2001 Arnett et al. ..... 439/676

* cited by examiner

*Primary Examiner* — Truc Nguyen
(74) *Attorney, Agent, or Firm* — Wei Te Chung; Andrew C. Cheng; Minh Chieh Chang

(57) ABSTRACT

An electrical connector includes an insulating housing and contacts made from metallic wire. The insulating housing includes a front portion with a mating cavity and a rear portion. Each contact includes a contacting portion, a leg portion and a connecting portion connecting with the contacting portion and the leg portion. Each leg portion includes a linking portion, a first soldering portion and a second soldering portion. The linking portion connects with the connecting portion and the first soldering portion, and the second soldering portion connects with the first soldering portion. Two soldering portions are on a same plane and parallel to each other.

16 Claims, 12 Drawing Sheets

ELECTRICAL CONNECTOR WITH METALLIC WIRE CONTACTS

BACKGROUND OF THE INVENTION

1. Field of the Invention

The present invention relates to an electrical connector, and particularly to a power connector with wire contacts.

2. Description of Related Arts

Conventional electrical connector generally includes an insulating housing and conductive contacts. Supernumerary components will be added in response to additional functions which electronic device needs to add, such as shielding shells and board locks. For example, the power connector transmitting power has a small number of contacts and need a large force of insertion and plug. Attendant problem is that the connection between soldering legs and the PCB might shake, resulting in bad soldering.

Hence, a new electrical connector is desired.

SUMMARY OF THE INVENTION

A major object of the present invention of to provide an electrical connector transmitting power, which has metallic wire contacts.

In order to achieve above-mentioned object, an electrical connector comprises an insulating housing and contacts made from metallic wire. The insulating housing comprises a front portion with a mating cavity and a rear portion. Each contact comprises a contacting portion, a leg portion and a connecting portion connecting with the contacting portion and the leg portion. Each leg portion comprises a linking portion, a first soldering portion and a second soldering portion. The linking portion connects with the connecting portion and the first soldering portion, and the second soldering portion connects with the first soldering portion. Said two soldering portions are on a same plane and parallel to each other.

Other advantages and novel features of the invention will become more apparent from the following detailed description of the present embodiment when taken in conjunction with the accompanying drawings

DETAILED DESCRIPTION OF THE PREFERRED EMBODIMENT

Further detailed description of the preferred embodiments of this present invention is set forth below along with the attached drawings.

Figure 1:
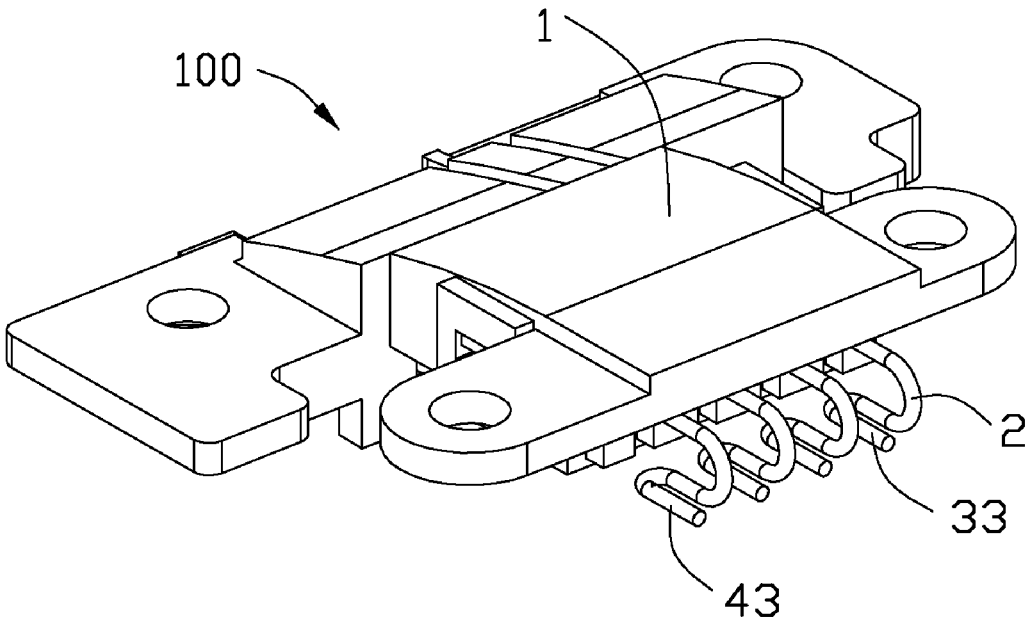
FIG. 1 is an assembled perspective view of an electrical connector of a first embodiment in accordance with the present invention from a top and rear view.
Figure 2:
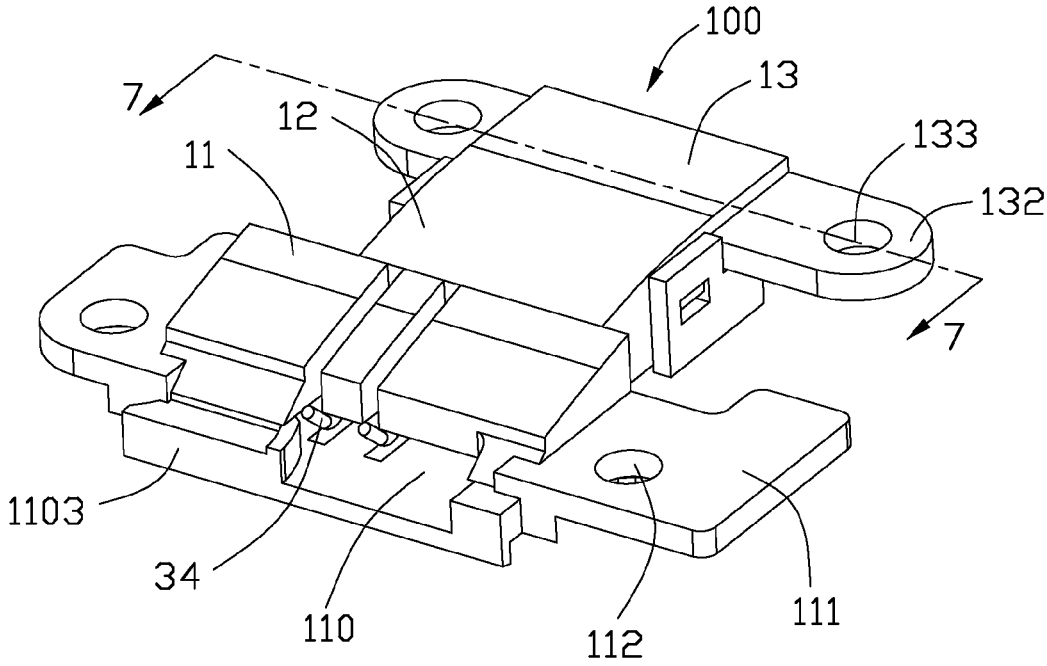
FIG. 2 is an assembled perspective view of the electrical connector from a top and front view.

Referring to FIGS. 1-2, an electrical connector 100 adapted for power transmission, includes an insulating housing 1 and a plurality of contacts 2. The contacts 2 are made from metallic wire and the soldering portions 33, 43 are of two stages in one plane. The insulating housing 1 includes a longitudinal front portion 11, which defines a mating cavity 110 through the front face 1103 and a rear face of the front portion 11 and a pair of thin first mounting portion 111 extending laterally from the mating cavity 110. The first mounting portion 111 defines a through hole 112 going through an upper and a lower face thereof. A longitudinal rear portion 13 and a middle portion 12 integrally connecting with the rear portion 13 and the front portion 11 are provided. The rear portion 13 includes a pair of thin second mounting portion 132 with through holes 133 extending laterally. The whole construction of the connector likes an airplane that the middle portion 12 is short in the longitudinal/first direction and thinner in the height/second direction, than the front and rear portions 11,13.

Figure 3:
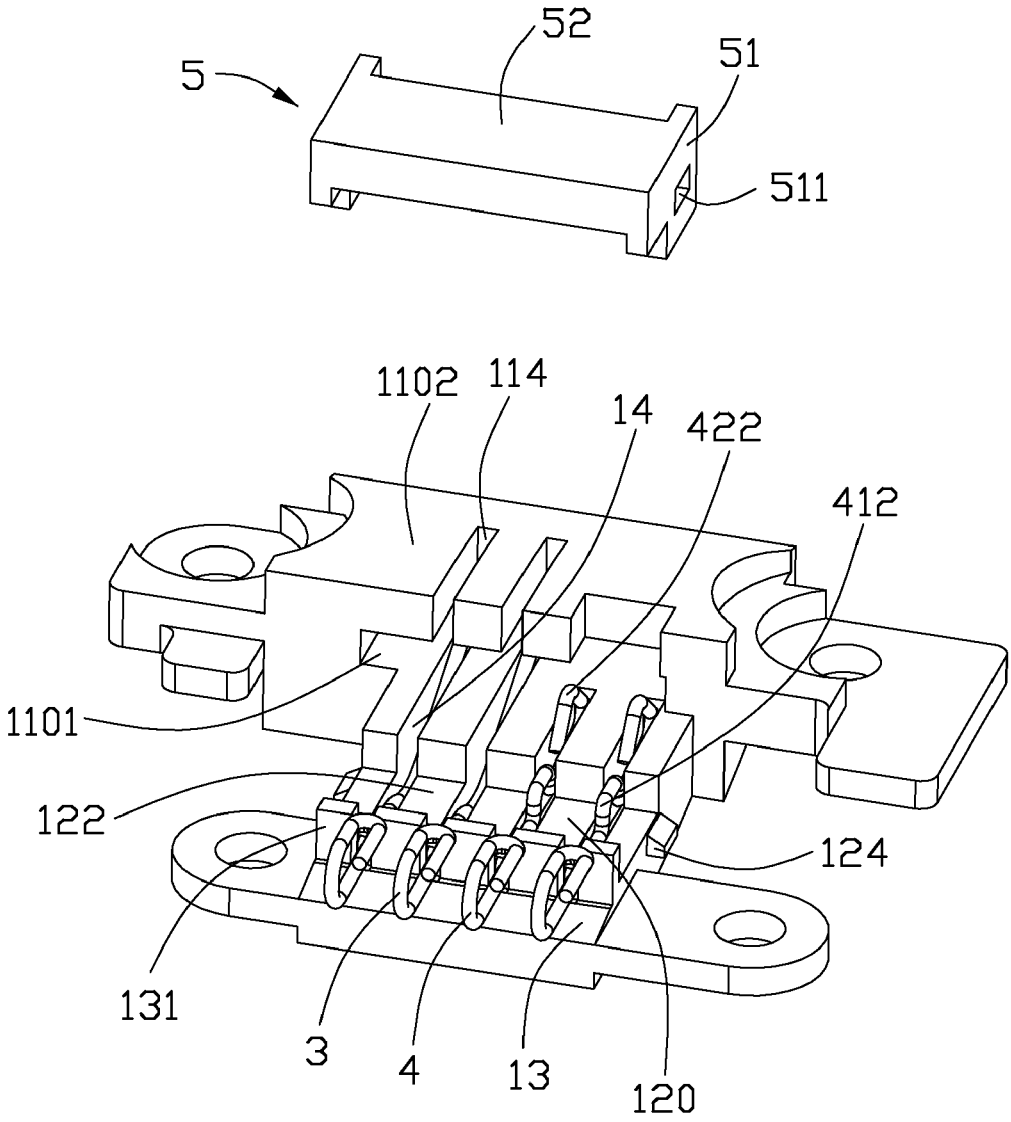
FIG. 3 is a partially exploded perspective view of the electrical connector.

Combination with FIG. 3, the middle portion 12 integrally extends from a top wall 1101 of the mating cavity 110. The middle portion 12 and the rear portion 13 are similarly on a same level of the top wall 1101 of the front portion 11. The size of the middle portion 12 in the first direction similarly equals to that of the mating cavity 110. A plurality of passageways 14 are defined on an inside of the top wall 1101 of mating cavity 110 and extend rearwards through the rear portion 13 along a bottom face 120 of the middle portion 12. The contacts includes two types, a pair of first contacts 3 and a pair of second contacts 4, which have circle cross sections. The contacts are known as piano wires, which have good elasticity performance.

Figure 4:
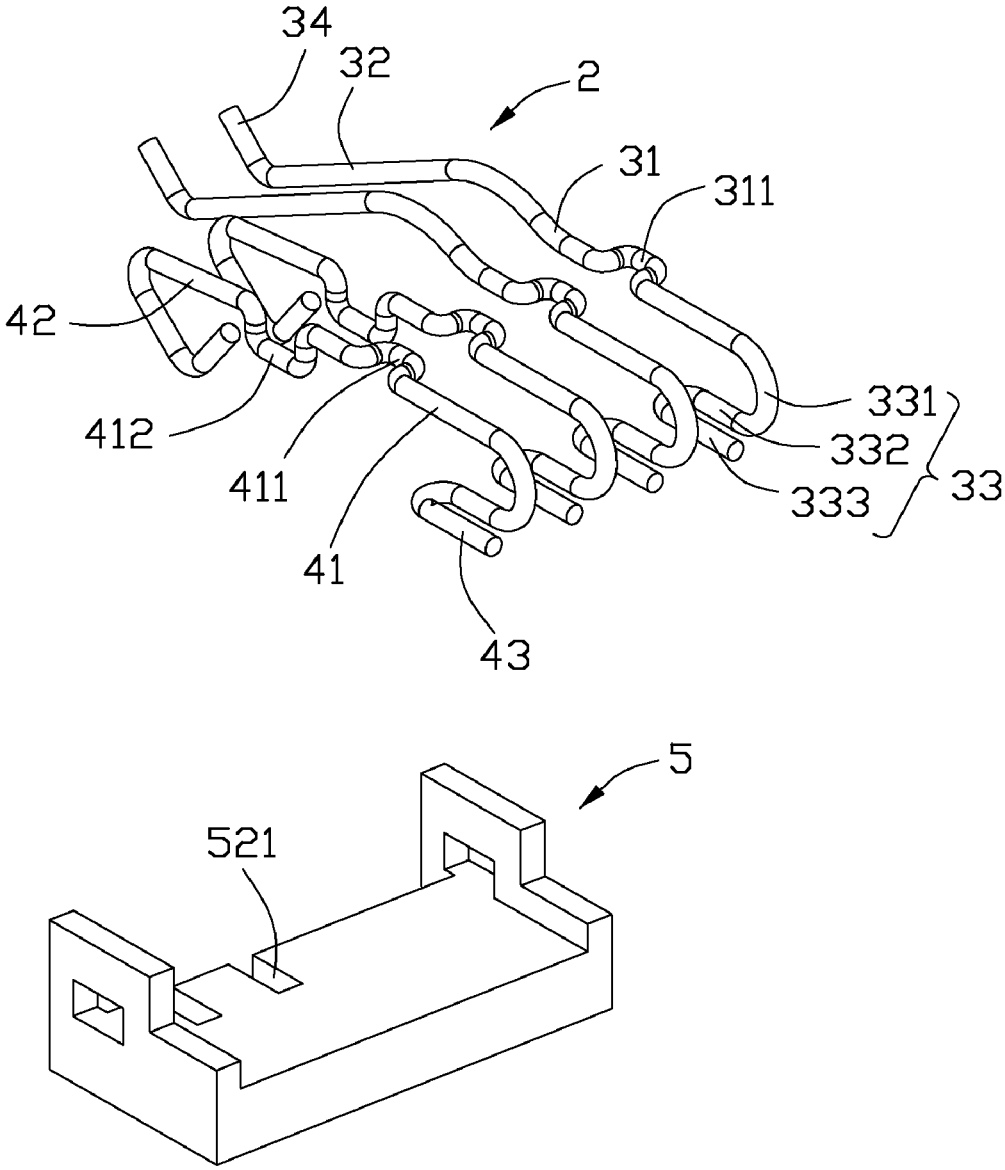
FIG. 4 is a perspective view of contacts and a cover of the electrical connector.

Referring to FIGS. 3 and 4, the first contact 3 includes a connecting portion 31, a contacting portion 32 extending forwards from the connecting portion and said leg portion 33 extending rearwards from the connecting portion. The contacting portions 32 and the connecting portions 31 are received in the passageways 14, and the contacting portion partly slant into the mating cavity 110 with a front end 34 reversely bending and backing to the passageways 14 as so to avoid scratching of a counter connector (not shown). The connecting portions 31 each define a lateral bending projection 311 bending along the first direction, at a middle portion thereof and the lateral bending projections 311 interference with inside face of the passageways 14 to retain the connecting portion 31 in the passageways and prevent from rotation of the first contacts 3. The leg portion 33 each includes a linking portion 311 bending from the connecting portion 31, and a first soldering portion 332 and a second soldering portion 334 in a same horizontal level. The first soldering portions 332 extend forwards from the linking portion 331 and the second soldering portions 333 extend rearwards from a front end of the first soldering portion 332. The first and the second soldering portions 332, 333 are parallel to each other. Said two soldering portions 332, 333 extend beyond the partition wall 131 and perpendicular to the rear portion 13. A bottom wall 1102 opposite to the top wall 1101 of the mating cavity 110 opens a pair of grooves 114 through two opposite surface and rear face thereof, which are aligned with the first contacts 3 in the passageways 14.

Figure 5:
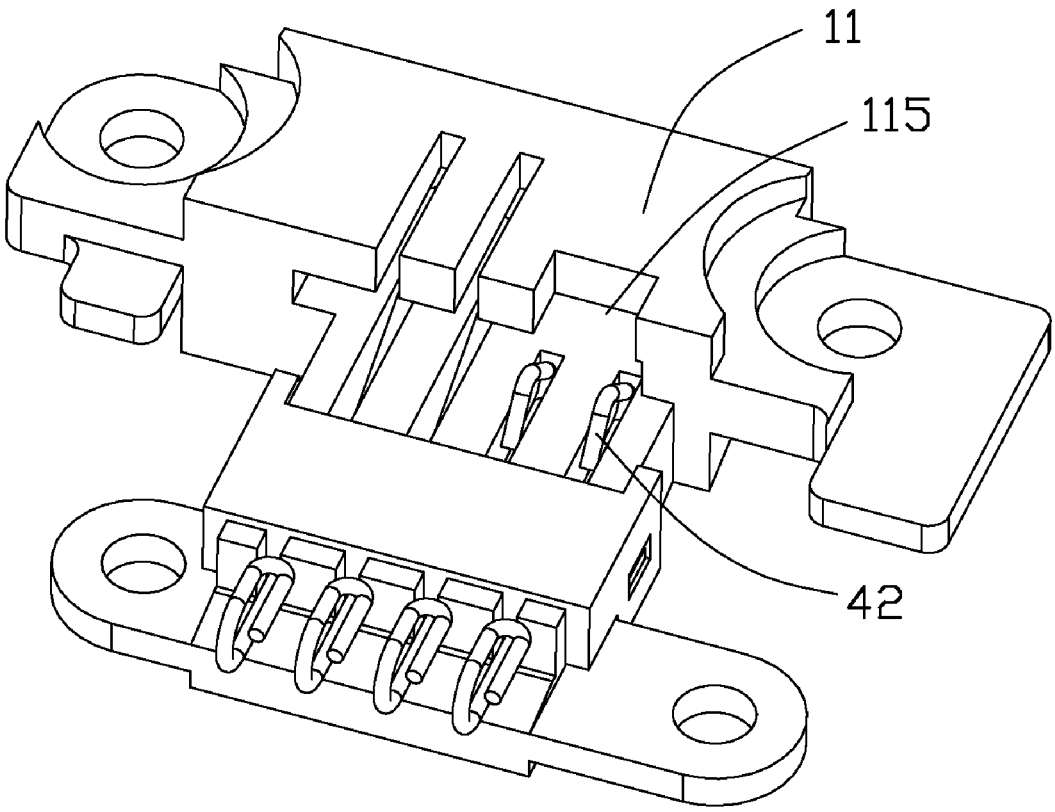
FIG. 5 is an assembled perspective view of the electrical connector from the bottom and rear view.
Figure 6:
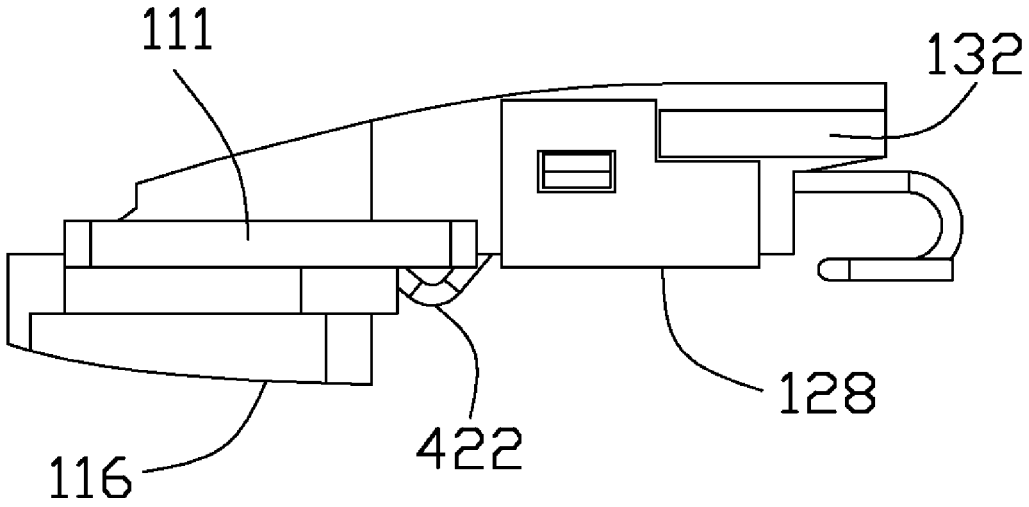
FIG. 6 is a side plane view of the electrical connector.

The second contact 4 includes a connecting portion 41, a contacting portion 42 extending forwards from the connecting portion and said leg portion 43 extending rearwards from the connecting portion. The contacting portion is of an inverted triangle and has peak point 422 projecting behind the mating cavity 110 as best shown in FIG. 6. The connecting portions 41 each define a lateral bending projection 411 at a middle portion thereof and an upwards bending projection 412 in front of the lateral bending projection 411. Said two bending projections 411,412 interference with insides of the passageways so as to prevent from rotation of the second contacts 4. The leg portions 43 are same to the leg portions 33 of the first contacts 3. The contacting portions 33 are in front of the contacting portion 42. The bottom wall 1102 of the mating cavity defines a notch 115 aligned with the contacting portions 42 as best shown in FIG. 5.

Figure 7:
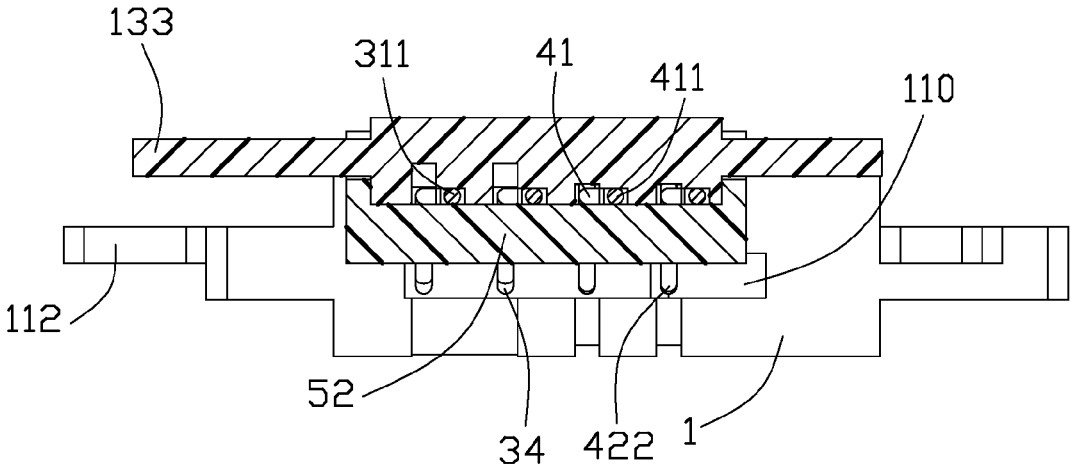
FIG. 7 is a cross sectional view taken along lines 7-7 in FIG. 2.

Please notes, the middle portion 12 defines a larger recess 122 therethrough in the first direction and the bending projections 311, 411,412 are located in the passageways 144 through the recess 122. A cover 5 overlay in the recess 122 to further protect the connecting portions. A base 52 of the cover is received in the recess 122 and a pair of side walls 51 perpendicularly extending from the base to lock boss portions 124 on two side faces of the middle portion 13 by a pair of holes 511 in the side walls 51. The base portion defines two grooves 521 thereon to accommodate with the upward bending projections 412. As shown in FIGS. 5 and 7, the base 52 of the cover press against the connecting portions 41 and the lateral bending projections 311, 411.

FIGS. 8 through 12 show an electrical connector 200 of a second embodiment, which is an improvement version of the electrical connector 100 of the aforementioned first embodiment. The connector 200 is similar to the electrical connector 100 wherein the same elements are designated by same reference numeral and terminology and omitted a detailed description. The electrical connector 200 is adapted for mating with a counter element 6. Referred to FIGS. 10 and 11, four contacts 2 are retained on the insulating housing 1 wherein the first and the second soldering portions 332, 333 of each contact 2 are on the same plane and the cover 5 is received in the recess 122 to overlap on the connecting portions of the contacts to fitly retain the contacts 2 in the passageways 14. The upward bending projections 412 are received in a hollow 123 recessed on the bottom face of recess 122.

The front portion 11 defines a mating cavity 150 running through a front face 1103 and the rear face thereof. Please notes, the mating cavity 150 differs from the mating cavity 110 of the first embodiment. The bottom wall of the mating cavity 150 is cut away and only remainders a front rib 153 to define a mating opening 154. The mating cavity 150 is configured with a main cavity 1501 and an affiliated cavity 1502 communicating with each other. The main cavity 1501 is align with the mating opening 154 and the affiliated cavity 1502 is at one side of the main cavity 1502 and stop by front slopping wall 155 of the front portion 11 of the insulating housing, i.e., the affiliated cavity 1502 do not go through the front face 1103. A pair of passageways 14*a* forwards run through the front face 1103 and rearward extend to the rear portion 13.

The mating element 6 includes a mating section 61, which is an arc shaped board, and link section 62 perpendicular to the mating section 61 and a handle section 64 parallel to the mating section. The mating section 61 has a step section 63 adjacent to the link section 62. Combination with FIG. 12 from a top plane view, the mating opening 154 has a lined inside 1541 and a curved inside 1542 opposite to the lined inside. The lined inside 1540 extends to corresponding inside of the mating cavity 150. The curved inside 1504 continues the inside 156 of the affiliated cavity 1502. The inside of the affiliated cavity 1502 include a slanting inside 1551 and a lined inside 1552 parallel to the lined inside 1541. The slanting inside 1551 joins with the lined inside 1552 and the curved inside 1542.

Figure 8:
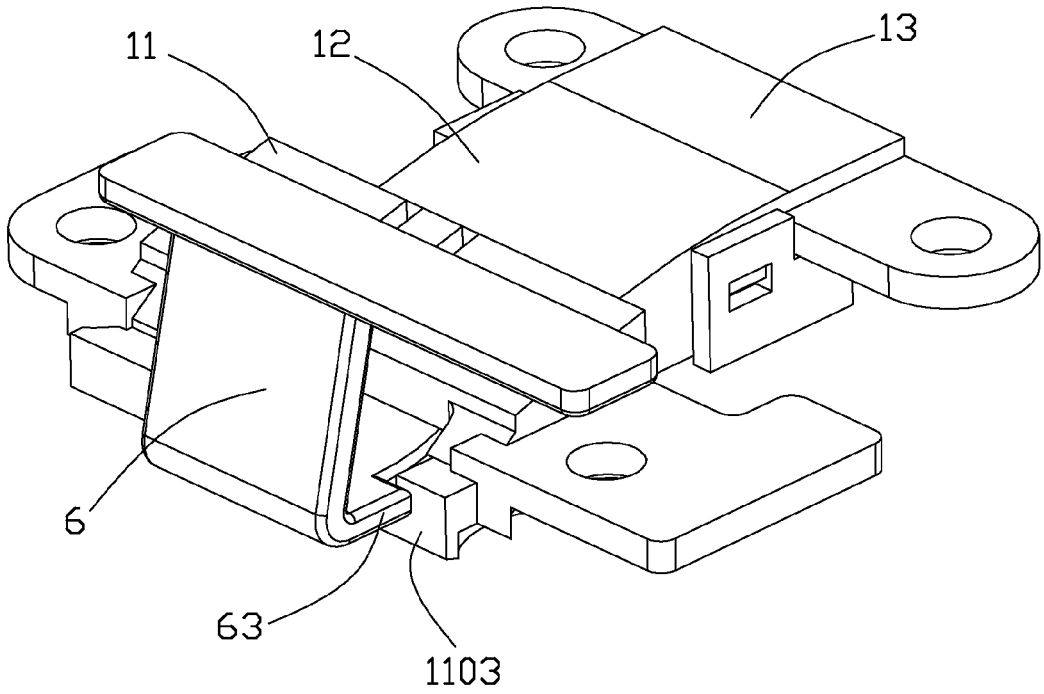
FIG. 8 is an assembled perspective view of an electrical connector of a second embodiment in accordance with the present invention from a top and front view, wherein a counter element is inserted in the electrical connector.
Figure 9:
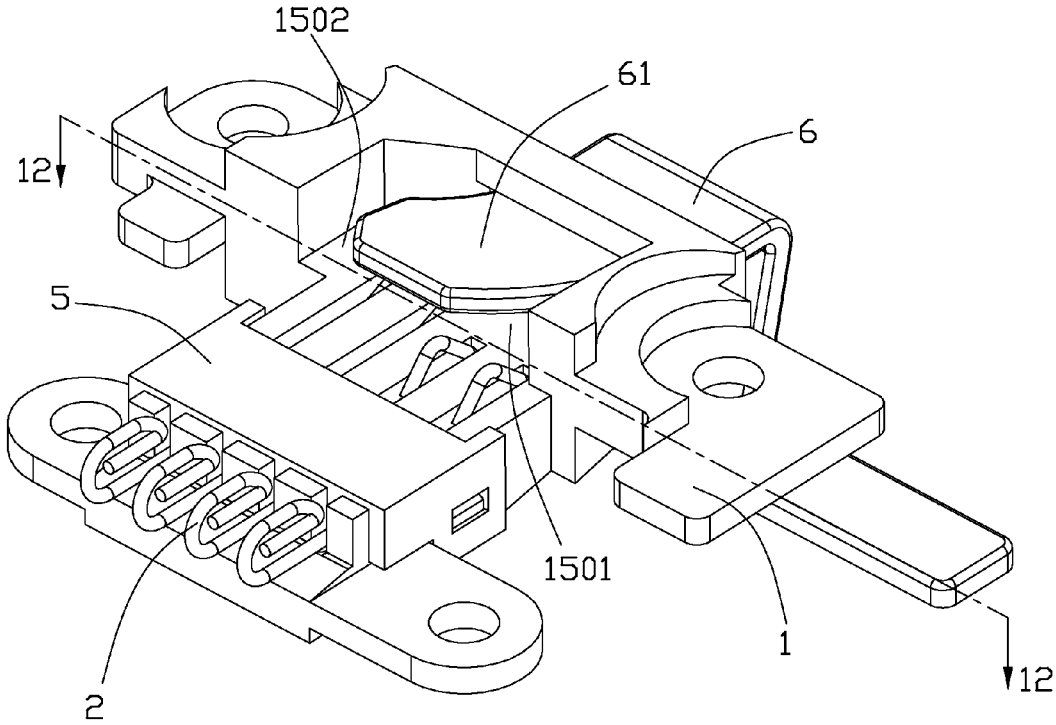
FIG. 9 is an assembled perspective view of the electrical connector and the counter element from a bottom and rear view.
Figure 10:
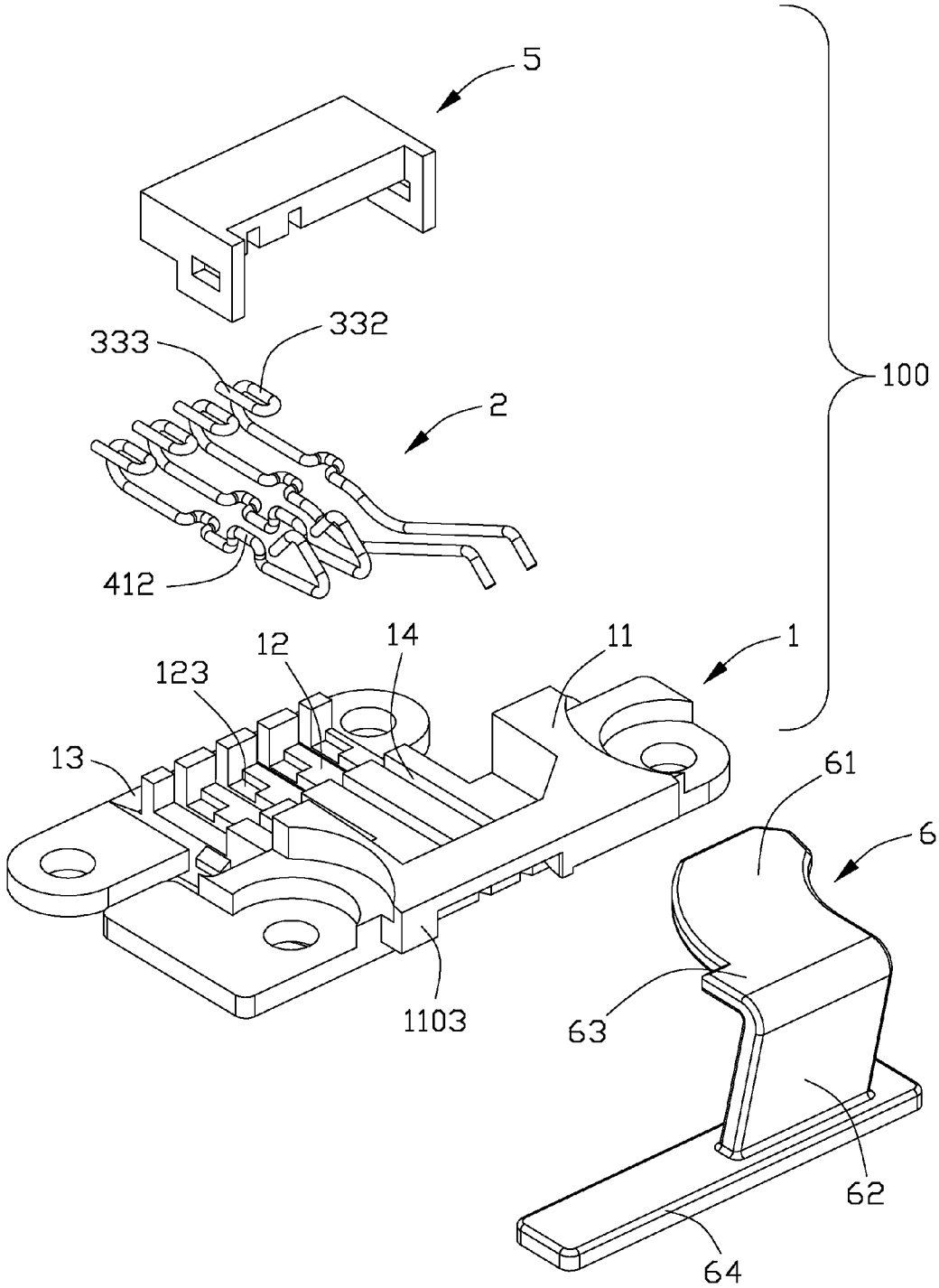
FIG. 10 is an exploded perspective view of the electrical connector and the counter element.
Figure 11:
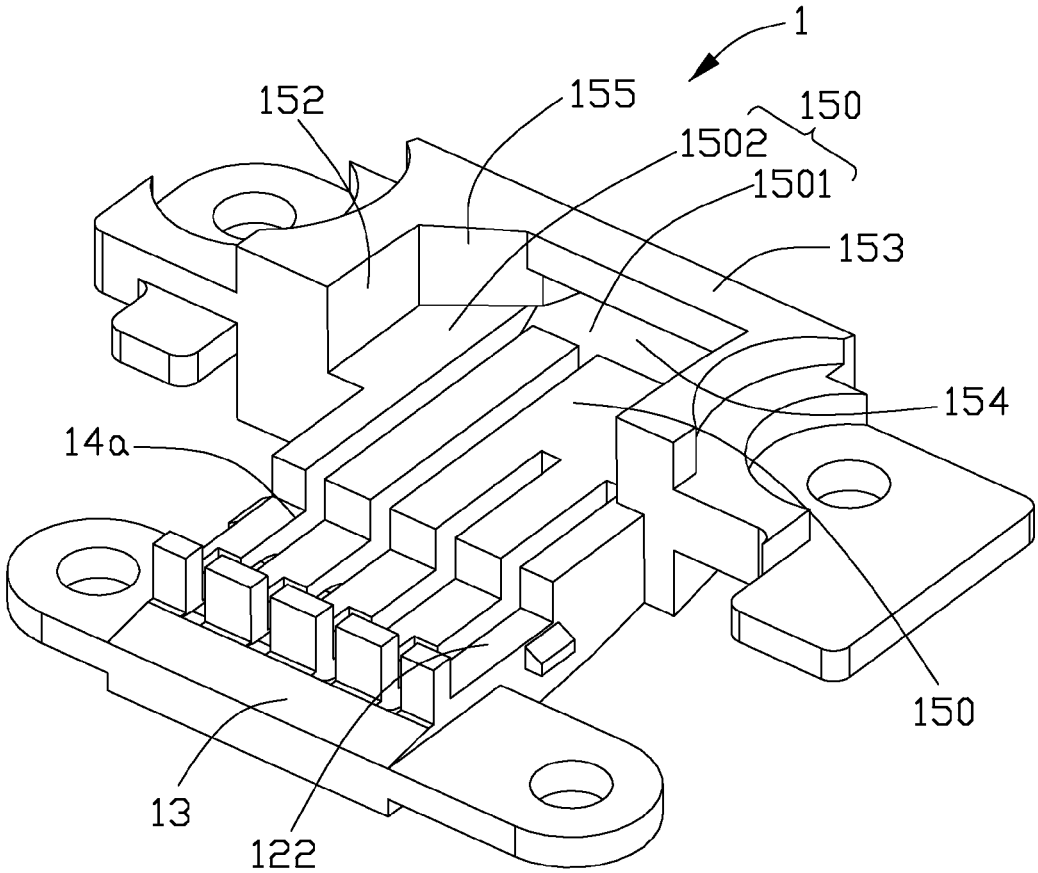
FIG. 11 is a perspective view of the insulating housing of the electrical connector.
Figure 12:
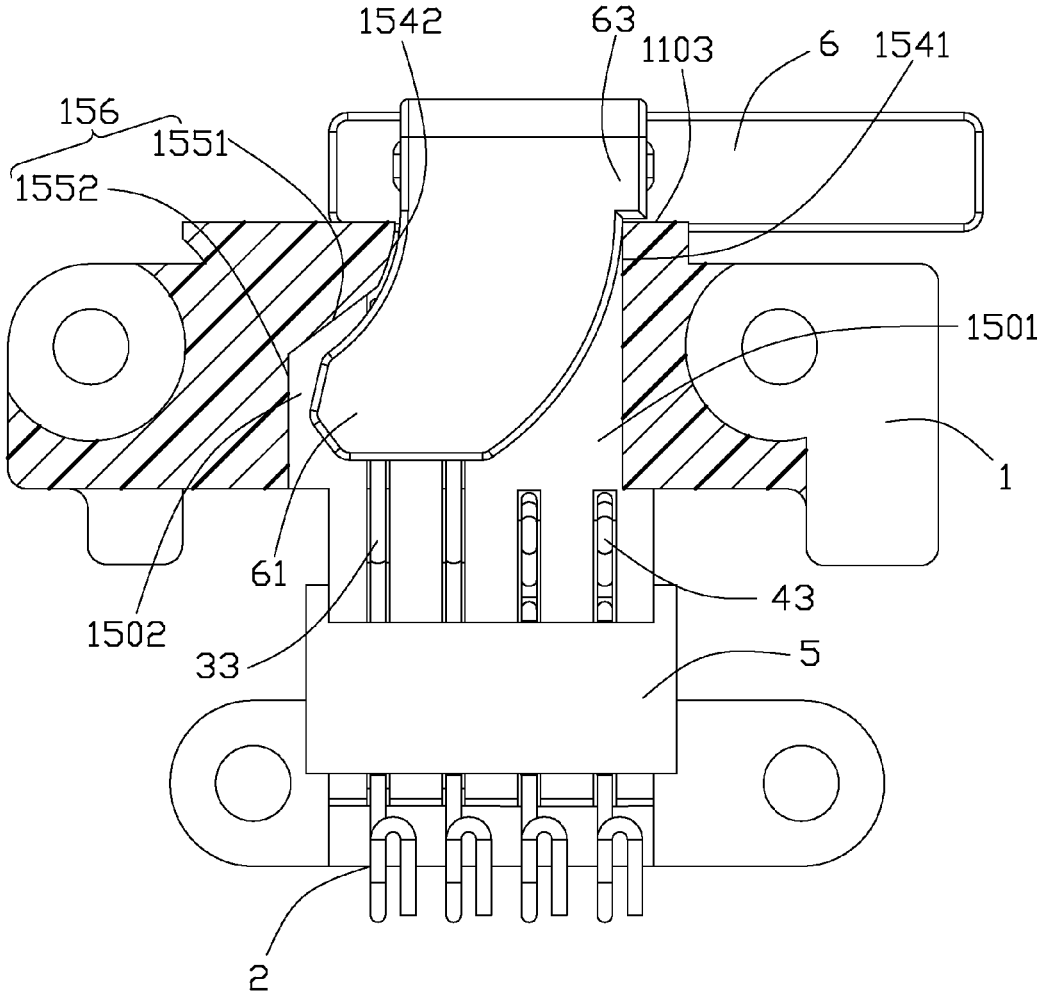
FIG. 12 is a cross sectional view of the electrical connector and the counter element taken along lines 12-12 in FIG. 9.

The mating section 61 of the counter element has a same width to the mating opening 154 so that the mating section 61 is inserted the mating cavity 15 through the mating opening 154. The arc shaped mating section 61 shift to the affiliated cavity 1501 in response to the insertion until the stop section 63 abuts against the front face 1103 of the mating cavity 150. The mating portion 61 will stop against the slanting inside 1551 and/or the curved inside 1542 of the mating cavity 150 from taking off, even an exterior force is exerted on the handle section 64. The affiliated cavity 1502 is located on the side of the first contact 3. The contacting portions 43 are located behind and will not be touched by the mating section 61. The mating section 61 of the counter element 6 touch the contacting portion 33 of the first contacts 3. As shown in FIG. 8, the hander section is located above the front portion 11.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

I claim:

1. An electrical connector comprising:

an insulating housing comprising a front portion with a mating cavity and a rear portion; and contacts made from metallic wire, each comprising a contacting portion, a leg portion and a connecting portion connecting with the contacting portion and the leg portion;

each leg portion comprising a linking portion, a first soldering portion and a second soldering portion, the linking portion connecting with the connecting portion and the first soldering portion, the second soldering portion connecting with the first soldering portion;

wherein said first and second soldering portions are on a same plane and parallel to each other;

wherein said first and second soldering portions of the contacts extend in a second direction perpendicular to a first direction along which the contacts are arranged;

wherein the connecting portions of the contacts each define a lateral bending projection projecting in the first direction.

2. The electrical connector as described in claim 1, wherein the connecting portions of the contacts further define upwards bending projections perpendicular to the lateral bending projections.

3. The electrical connector as described in claim 2, wherein a cover is provided to overlap the connecting portions of the contacts.

4. The electrical connector as described in claim 1, wherein the mating cavity includes a main cavity running through a front face of the front portion and an affiliated cavity at one side of and accommodating with the main cavity, the affiliated cavity do not run through the front face.

5. The electrical connector as described in claim 1, wherein insulating housing comprising a middle portion integrally connecting with the front portion and the rear portion, the middle portion extend from a top wall of the mating cavity, a plurality of passageway are defined on the top wall and extend rearwards to receive the contacts.

6. The electrical connector as described in claim 5, wherein the front portion and the rear portion define a pair of mounting portion at opposite ends thereof, respectively.

7. The electrical connector as described in claim 1, wherein the contacts comprises a pair of first contacts and a pair of second contacts, the contacting portions of the first contacts project in the mating cavity the contacting portions of the second contacts are located behind the mating cavity.

8. The electrical connector as described in claim 7, wherein the contacting portions of the first contacts slantwise extend to the mating cavity and the contacting portions of the second contacts of an inverted triangle accommodate in passageways defined to receive the contacts.

9. An electrical connector assembly comprising:

an insulating housing comprising a front portion with a mating cavity and a rear portion, the mating cavity running through a front face of the front portion with a mating opening; and a pair of first contacts arranged in the insulating housing, each first contact comprising a contacting portion, a leg portion and a connecting portion connecting with the contacting portion and the leg portion;

the mating cavity includes a main cavity in which the contacting portions of the first contacts projecting and an affiliated cavity at one side of and communicating with the main cavity; wherein the main cavity is aligned with the mating opening and the affiliated cavity does not run through the front face but hidden behind the front face;

wherein each leg portion comprising a linking portion, a first soldering portion and a second soldering portion;

wherein said first and second soldering portions are on a same plane and parallel to each other;

wherein first and second soldering portions of the contacts extend in a second direction perpendicular to a first direction along which the contacts are arranged;

wherein the connecting portions of the contacts each define a lateral bending projection projecting in the first direction;

wherein the contacts are made from metallic wire.

10. The electrical connector assembly as described in claim 9, wherein a pair of second contacts is located at another side opposite to the affiliated cavity, and the second contacts are aligned with and behind the main cavity.

11. The electrical connector assembly as described in claim 10, wherein the second contacts includes leg portions, each leg portion of the first and the second contacts has two soldering portions on a same plane.

12. The electrical connector assembly as described in claim 9, wherein the affiliated cavity is configured with a non-linear oblique boundary transversely facing the main cavity so as to have a mating tongue of a complementary connector inserted into the mating cavity essentially in a rotational manner rather than in a linear manner or a translational manner.

13. The electrical connector assembly as claimed in claim 12, wherein said mating tongue of the complementary connector defines a long curved edge and a short curved edge under condition that said short curved edge confronts the affiliated cavity while the long curved edge faces oppositely.

14. The electrical connector assembly as claimed in claim 9, further including a pair of second contacts with corresponding contacting portions projecting into the affiliated cavity, wherein the contacting portions of the first contacts extend forwardly longer than the contacting portions of the second contacts along a front-to-back direction.

15. An electrical connector assembly comprising:

an insulative housing defining a mating cavity in a front portion and a plurality of slit type passageways extending along a front-to-back direction and communicating with the mating cavity in a transverse direction perpendicular to said front-to-back direction;

a plurality of contacts respectively disposed in the corresponding passageways, each of said contacts formed by a metallic wire and defining a rear soldering section, a front deflectable contacting section and a connection section therebetween; wherein said connection section defines at least one crankshaft like structure to be either at least snugly held in the corresponding passageway or lying down in a hollow beside the corresponding passageway so as to prevent self-rotation of the contact in the corresponding passageway;

wherein said rear soldering portion comprising a linking portion, a first soldering portion and a second soldering portion;

wherein said first and second soldering portions are on a same plane and parallel to each other;

wherein first and second soldering portions of the contacts extend in a second direction perpendicular to a first direction along which the contacts are arranged.

16. The electrical connector assembly as claimed in claim 15, further including a cover attached to the housing, wherein said cover defines either a plurality of grooves corresponding to the passageway to commonly hold said crankshaft structure or a plate covering said hollow so as to efficiently have said crankshaft like structure in position in the housing.

* * * * *